US007562473B2

(12) United States Patent
Westendorf et al.

(10) Patent No.: US 7,562,473 B2
(45) Date of Patent: Jul. 21, 2009

(54) MATERIAL-HANDLING BUCKET WITH SCRAPER BLADE

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 67 days.

(21) Appl. No.: 10/950,905

(22) Filed: Sep. 27, 2004

(65) Prior Publication Data

US 2006/0070268 A1 Apr. 6, 2006

(51) Int. Cl.
*E02F 3/76* (2006.01)

(52) U.S. Cl. ..... 37/407; 37/408; 37/268

(58) Field of Classification Search ..... 37/403, 37/405, 407, 409, 410, 411, 444, 903
See application file for complete search history.

(56) References Cited

U.S. PATENT DOCUMENTS

| | | | | | |
|---|---|---|---|---|---|
| 1,856,148 | A | * | 5/1932 | Ball | 172/136 |
| 2,774,155 | A | * | 12/1956 | Hipp | 172/145 |
| 2,899,760 | A | * | 8/1959 | Armington et al. | 172/777 |
| 3,034,238 | A | * | 5/1962 | McGee | 172/777 |
| 3,109,248 | A | * | 11/1963 | Vos | 37/408 |
| 3,218,740 | A | * | 11/1965 | White | 37/408 |
| 4,051,962 | A | | 10/1977 | Westendorf | |
| 4,056,205 | A | * | 11/1977 | Etzler, IV | 414/722 |
| 4,230,435 | A | * | 10/1980 | Azevedo | 414/722 |
| 4,261,115 | A | * | 4/1981 | Chittenden | 37/268 |
| 4,266,906 | A | | 5/1981 | Langenfeld et al. | |
| 4,512,090 | A | * | 4/1985 | Billings | 37/405 |
| 4,601,634 | A | | 7/1986 | Langenfeld et al. | |
| 4,709,492 | A | * | 12/1987 | Watson | 37/232 |
| 4,729,180 | A | * | 3/1988 | Hendricks | 37/450 |
| 4,797,051 | A | | 1/1989 | Langenfeld et al. | |
| 4,886,124 | A | * | 12/1989 | Kleinhuizen | 172/32 |
| 4,887,939 | A | | 12/1989 | Langenfeld et al. | |
| 4,915,575 | A | | 4/1990 | Langenfeld et al. | |
| 5,172,499 | A | | 12/1992 | Griffin | |
| 5,456,028 | A | * | 10/1995 | Larson | 37/404 |
| 5,515,625 | A | | 5/1996 | Keigley | |
| 5,564,885 | A | * | 10/1996 | Staben, Jr. | 414/724 |
| 5,715,613 | A | * | 2/1998 | Ebert | 37/266 |
| 6,256,910 | B1 | * | 7/2001 | Grozde | 37/266 |
| 6,311,417 | B1 | * | 11/2001 | Pratt | 37/404 |
| 6,434,863 | B1 | * | 8/2002 | Meurer | 37/410 |
| 6,490,815 | B1 | * | 12/2002 | Pratt | 37/408 |
| 6,546,650 | B1 | * | 4/2003 | Meurer | 37/405 |
| 6,817,121 | B2 | * | 11/2004 | Grgic | 37/410 |
| 6,860,039 | B2 | * | 3/2005 | Schultz et al. | 37/231 |
| 6,910,290 | B1 | * | 6/2005 | Meurer | 37/405 |
| 7,287,344 | B2 | * | 10/2007 | Kostyak | 37/407 |

* cited by examiner

*Primary Examiner*—Thomas A Beach
(74) *Attorney, Agent, or Firm*—Dowell Baker, P.C.

(57) ABSTRACT

A material-handling bucket which includes a blade with scarifying teeth on the rear of the bucket. By raising the bucket and rolling the bucket backward, the blade and teeth can be made to engage the ground to provide grading and scarifying capabilities for a conventional loader bucket. The blade and scarifying teeth, however, do not interfere with the normal loading operations of the bucket.

18 Claims, 3 Drawing Sheets

MATERIAL-HANDLING BUCKET WITH SCRAPER BLADE

FIELD OF THE INVENTION

The present invention relates generally to implements for use with tractors, skid steers and the like, and more specifically to a material-handling bucket for use as a loader on such vehicles.

BACKGROUND OF THE INVENTION

Material-handling buckets, or loaders, are common attachments for many types of equipment including tractors, skid steers, four wheelers and bulldozers. Loaders are most often attached to the front of such equipment with arms and hydraulic controls that allow the loader to be raised and lowered, and also rolled forward and backward. Although front-end loaders are designed for handling and transporting large amounts of bulk material, equipment operators typically use the loader for many other tasks.

For example, the front-end loader may be used to dig and excavate earth and soil. Operators may also use the loader to grade and level soil or other surface material after digging or excavating. The loader may also be used to break up earth and soil prior to excavating or leveling. Although front-end loaders are commonly used for these tasks, present loader designs are not optimal for scraping, grading and scarifying surface material.

When using the front-end loader on a tractor to dig or excavate soil, the front lip of the bucket is rotated downward and forced into the soil using the forward motion of the tractor. When the front lip of the bucket reaches the desired depth, the bucket is then rotated backwards so that the bottom of the bucket is level with the ground. Using the forward motion of the tractor, the soil can be dug and scooped into the bucket. However, when digging in this manner, the bucket blocks the operator's view of the digging area and makes it difficult for the operator to judge the optimal cutting depth.

When using the front-end loader to grade or level soil, the rear edge of the bottom surface of the bucket may be placed on the ground and the bucket dragged backward to pull earth and soil behind the bucket. This method, however, has disadvantages because the design of conventional buckets does not allow for much soil to accumulate behind the bucket when used in this manner. Also, the rear surface of conventional buckets is not specifically designed and reinforced to provide for scraping and grading in this manner.

The front edge of the bucket may also be used for scraping and grading. The front-end loader may be raised and the bucket rotated forward so that the bottom of the bucket is essentially vertical and the front edge of the bucket is in contact with the ground. The front edge of the bucket may then be dragged backward to pull earth and soil behind the bucket to grade the surface. This method also has disadvantages because tremendous torque is placed on the bucket when it is dragged backward in this position, creating undue wear and tear on the hydraulic cylinders that control the rotation of the bucket. The front edge of the bucket is also not specifically designed and reinforced to provide for scraping and grading in this manner.

Although a front-end loader may be used to break up discrete amounts of soil, conventional front-end loaders are not capable of scarifying large amounts of soil. To break up discrete amounts of soil, the bucket may be rotated forward so that the bottom of the bucket is essentially vertical. The bucket can then be lowered to drive the front edge bucket into the ground and break up the soil. This procedure can be repeated with the vehicle moved incrementally to create a series of cuts in the ground. This procedure, however, is time consuming, ineffective for scarifying a large area of ground and utilizes the hydraulics of the front-end loader rather than the forward or backward motion of the vehicle to break up the soil. Conventional front-end loaders have no means for scarifying soil while the vehicle is in motion or for scarifying the ground parallel to the direction of travel of the vehicle.

The need for versatile implements capable of transporting material and also grading/scraping/scarifying has been recognized in the prior art. U.S. Pat. No. 5,172,499 issued to Griffin discloses a modified box scraper that is also capable of collecting, transporting and dumping soil or other bulk material. This implement, however, does not have the versatility or functional utility of a conventional loader. Also, collected material must be manually dumped by activating a lever that releases the bottom wall of the collection box. Thus, although the disclosed implement is apparently effective for conventional scraping and grading, it does not provide the recognized benefits and utility of a conventional loader.

The need for scarifying teeth in combination with other functional features of an implement is also recognized in the prior art. Box graters/scrapers with scarifying teeth are common implements for tractors. These implements are typically attached to the rear three-point hitch on a tractor and pulled behind the tractor to break up, grate and level soil and other surface material. U.S. Pat. No. 5,515,625 issued to Keigley also discloses a rake implement for use with a skid steer that also includes removable scarifying teeth behind the rake. As noted by Keigley, the scarifying teeth "permit deep penetration and scarifying of the earth while still permitting the tines comprising the rake blade to level and work the soil." However, although the benefit of combining scarifying teeth with other functional features of a tractor or skid steer implement has been recognized, scarifying teeth have not been effectively utilized in combination with a conventional loader.

Accordingly, an object of the present invention is to provide a loader that is capable of more effectively digging, grading and scarifying surface material.

A further object of the present invention is to provide a loader that is less subject to undue wear and tear when used for digging, grading and scarifying surface material.

Yet another object of the present invention is to provide a grader blade component for a conventional loader that does not interfere with the normal operation of the loader.

An additional object of the present invention is to provide scarifying teeth for a conventional loader that do not interfere with the normal operation of the loader.

A still further object of the present invention is to provide a combination grader blade with scarifying teeth for a conventional loader that does not interfere with the normal operation of the loader.

Still another object of the present invention is to provide a grader blade, scarifying teeth, or a combination grader blade with scarifying teeth that may be added to an existing loader or other conventional implement that does not interfere with the normal operation of the implement.

Yet another object of the present invention is to provide an improved method for digging, grading, scraping and/or scarifying earth with a conventional front-end loader.

Finally, an object of the present invention is to provide a combination loader/grader/scraper that is economical to manufacture, durable and refined in appearance.

SUMMARY OF THE INVENTION

The preferred embodiment of the present invention provides a blade with scarifying teeth on the rear surface of a conventional loader bucket. By rolling the bucket backward, the rear blade can be placed in contact with or inserted into the ground. In this position, the rear blade can also be dragged backward for scraping and grading. By rolling the bucket further backward, the scarifying teeth can be made to engage the ground with the blade in contact with the surface of the ground. Thus, when the rear blade is dragged backward in this position, the scarifying teeth break up the soil in advance of the blade. In some embodiments of the present invention, the bucket may be rolled still further backward so that the scarifying teeth engage the ground with the blade raised from the ground. When dragged backward or pushed forward in this position, the scarifying teeth may be used to break up the ground without simultaneously grading or collecting the scarified ground.

The rear scraping and scarifying blade does not interfere with normal operation of the loader. When material is scooped into the bucket with the bottom of the loader level to the ground or titled forward, the rear blade does not engage the ground. When the loader is lifted and tilted backward when transporting material, and when the loader is dumped, the rear blade remains out of the way at the rear of the bucket. Thus, the rear blade does not obstruct movement or rotation of the loader bucket, and also does not interfere with material being collected or dumped from the bucket.

The preferred embodiment of the present invention offers the advantage of improving the grading and earth leveling capabilities of a conventional loader without interfering with the normal operation of the loader. This and other advantages will become apparent as this specification is read in conjunction with the accompanying drawings and appended claims.

DETAILED DESCRIPTION

The present invention may be used with any vehicle having the means to raise and lower, and also rotate forward and backward, a material-handling bucket. Although the preferred embodiment of the present invention is intended for use as a front-end loader such as those mounted on the front or forward end of a tractor or skid steer, those of skill in the art will recognize that the present invention is equally adaptable for use with other types of loaders. For example, the present invention may be used with a loader mounted on the rear of a tractor. The present invention may also be used with loaders mounted on other vehicles including four wheelers and bulldozers. However, for descriptive purposes, the present invention will be described in use on a front-end loader.

Figure 1:
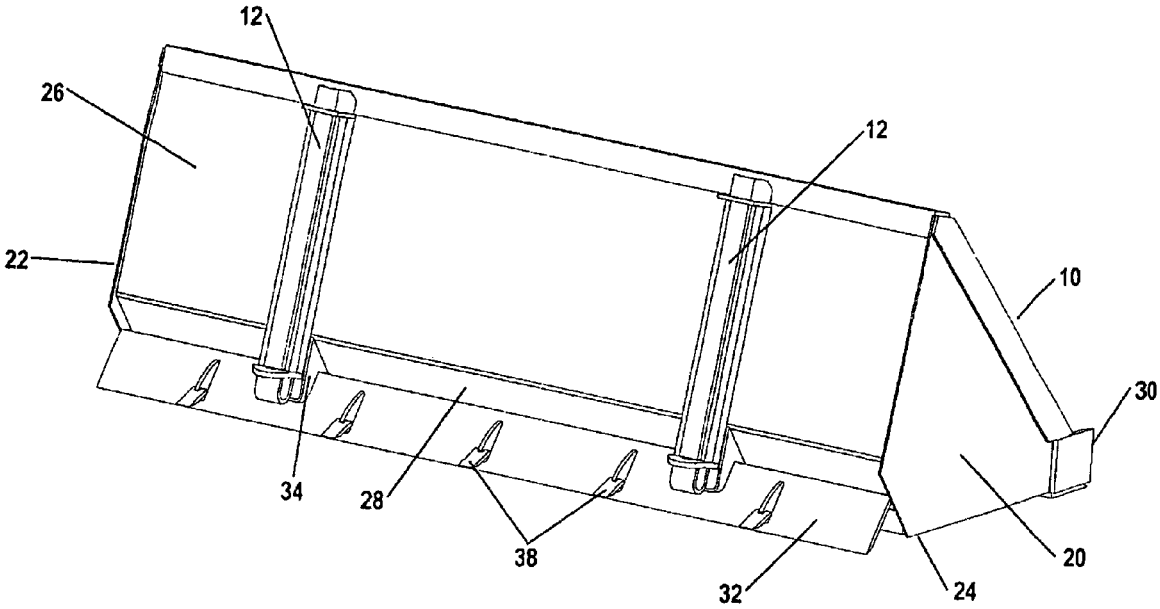
FIG. 1 is a perspective view of the improved material-handling bucket with scraper blade and scarifying teeth of the present invention.

FIG. 1 shows a material-handling bucket 10 of the present invention. The bucket 10 includes mounts 12 for pivotally attaching the bucket to vertically movable arms (not shown) about a pivot point. The arms are in turn connected to a tractor, skid steer or other vehicle (not shown) about another pivot point. The bucket 10 may be raised and lowered in relation to the vehicle by the vertically movable arms. By further means well known in the art, the bucket 10 may also be rolled forward and backward. The bucket is typically raised and lowered, and also rolled forward and backward, with hydraulic cylinders (not shown), although other means are well known in the art. Finally, the bucket 10 may be moved horizontally by movement of the vehicle to which it is attached, but other means for horizontal movement of the bucket 10 are also contemplated and within the scope of the present invention.

The bucket 10 includes a first side panel 20, a second side panel 22, a bottom panel 24, an upper rear panel 26 and a lower rear panel 28. The front edge 30 of the bucket 10 is also identified in FIG. 1.

The bucket 10 of the present invention also includes a blade 32 mounted on the rear panel 26. The blade 32 is preferably welded to the lower rear panel 28 and supported by upper braces 34 and lower braces 36 (shown in FIG. 2) welded to the blade 30 and the lower rear panel 28. The blade 30 also includes a plurality of scarifying teeth 38 welded to the blade 32.

Other means for attaching the blade 32 and scarifying teeth 38 to the bucket 10 will be readily apparent to those of skill in the art. For example, the blade may be bolted to supports attached to the bucket 10, allowing the blade to be easily replaced if it should become worn or broken during use. The scarifying teeth may also be bolted in place so that they can be easily replaced either individually or as a set. The blade and teeth may also be connected to the bucket 10 by means of pins or other connectors that allow them to be easily interchanged with blades and/or teeth of different sizes or grades, as is well known in the art of tractor and skid steer implements.

The blade 32 may also be constructed so that it is integral with the bucket 10. For example, the upper rear panel 26 could be extended beyond the joint 40 shown in FIGS. 2-4 to create a rear blade portion that extends from the rear of the bucket 10. Such an extension of upper rear panel 26, or other extensions or modifications to the components of bucket 10, would be within the scope of the present invention and readily apparent to those of skill in the art.

Figure 2:
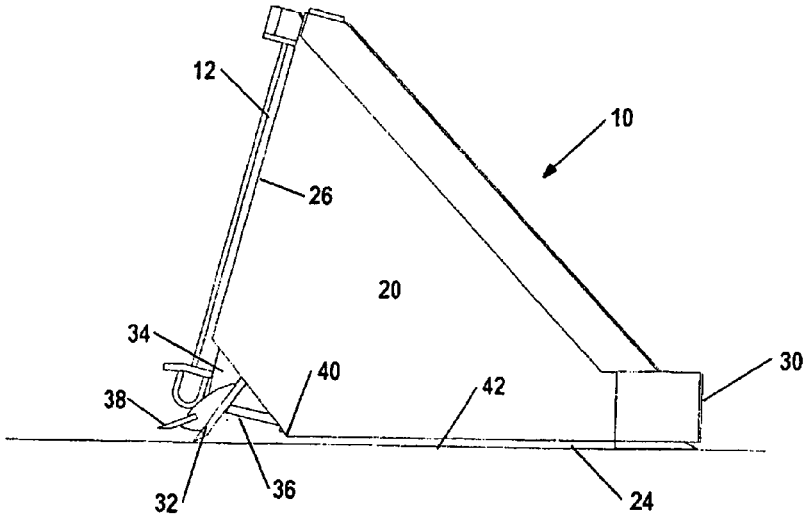
FIG. 2 is a side view of the improved material-handling bucket of the present invention with the bucket placed on the ground.

As shown in FIG. 2, the blade 32 and scarifying teeth 38 do not engage the ground 42 when the bottom 24 of the bucket 10 is placed on the ground 42. In this position, the bucket 10 may be moved forward to collect material in the bucket 10. The bucket may then be lifted from the ground 42 for transport of the material, and the material dumped from the bucket 10, all without interference or obstruction from the blade 32 and scarifying teeth 38.

Figure 3:
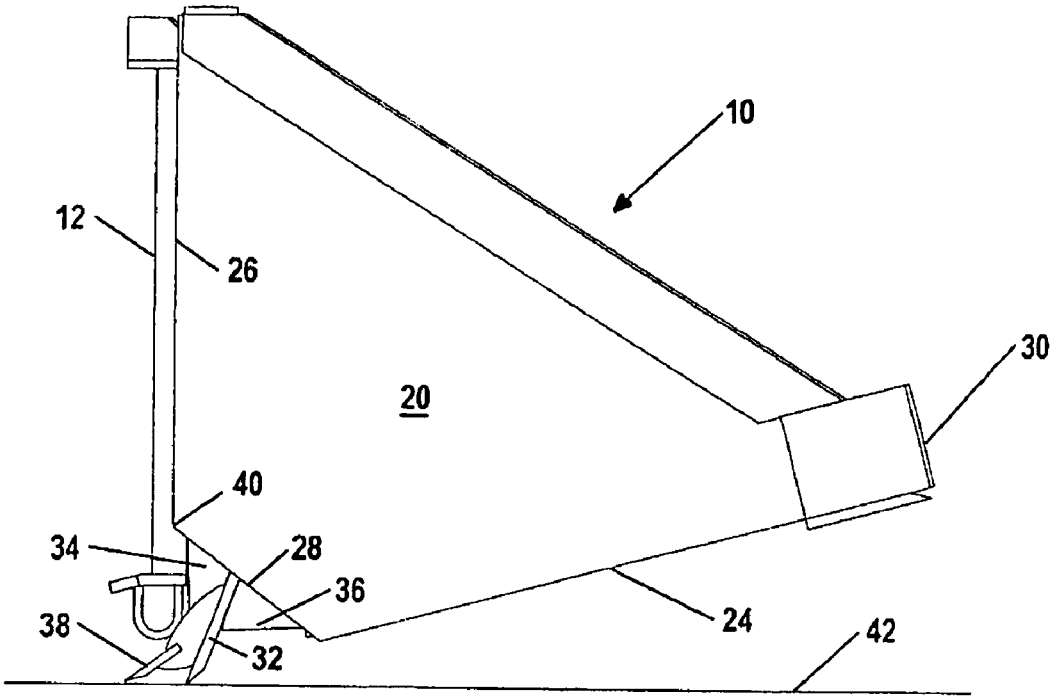
FIG. 3 is a side view of the improved material-handling bucket of the present invention with the bucket rolled back to engage the blade with the ground for grading and leveling.

As shown in FIG. 3, the bucket 10 may be rolled backward slightly so that the blade 32 contacts the ground 42 but the bottom panel 24 of the bucket 10 does not contact the ground 42. Although the blade 32 is in contact with the ground 42, the scarifying teeth 38 do not engage the ground 42. In this position, the bucket 10 and blade 32 may be pulled backward by the vehicle to grade and level the ground 42 with the blade 32. The blade 32 may also be lowered into the ground 42 in this position and pulled backward to dig into the ground 42.

Figure 4:
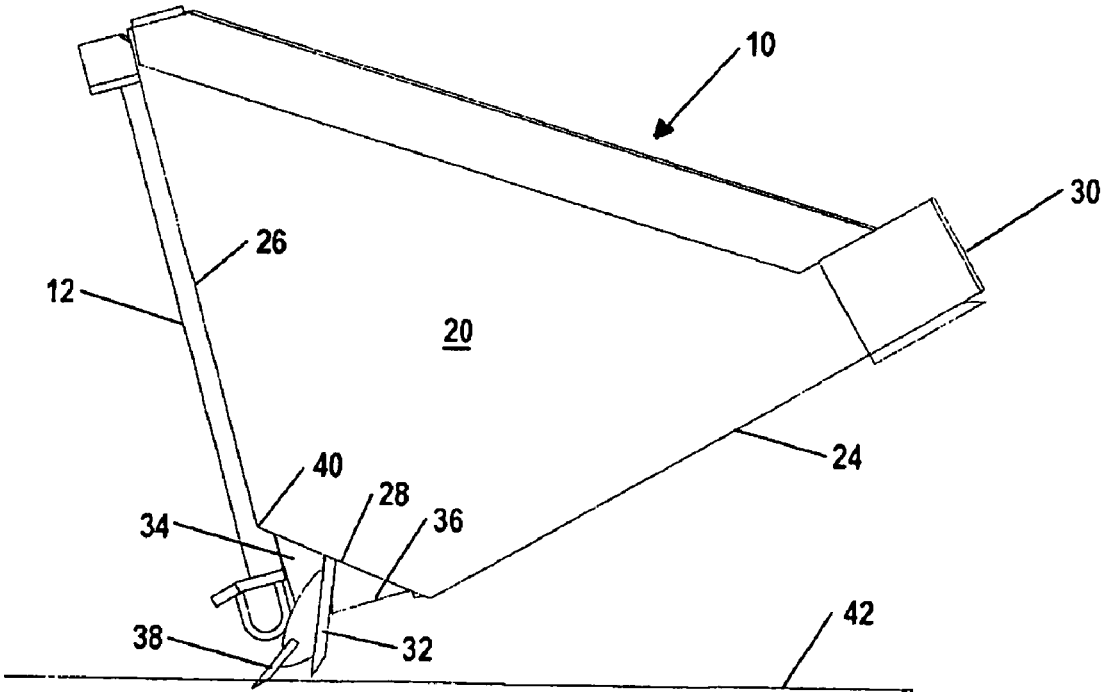
FIG. 4 is a side view of the improved material-handling bucket of the present invention with the bucket rolled back still further so that the scarifying teeth engage the ground.

As shown in FIG. 4, the bucket 10 may be rolled backward still further so that the blade 32 contacts the ground 42 and the scarifying teeth 38 engage the ground 42. In this position, the bucket 10 and blade 32 may be pulled backward by the vehicle so that the scarifying teeth 38 break up the ground 42 in advance of the blade 32.

Depending upon the means by which the bucket 10 is attached to a vehicle, the bucket 10 may be rolled backward even further when used with some vehicles so that the scarifying teeth 38 engage the ground 42 but the blade 32 is raised from the ground. In this position, the scarifying teeth 38 may be used to break up the ground without simultaneously grading or collecting the scarified ground. The vehicle may then easily collect the scarified ground in the bucket 10 on a return pass.

The inventors contemplate several modifications that may be made to the preferred embodiment of the present invention that fall within the scope of the invention. For example, the blade 32 may be implemented and used without scarifying teeth 38. The scarifying teeth 38 may also be used according to the present invention without the blade 32. It is contemplated that the scarifying teeth 38 may be connected directly to the bucket 10 by any number of means known to those of skill in the art. In this embodiment, the scarifying teeth 38 would remain effective for breaking up earth and soil with a loader or other implement.

Figure 5:
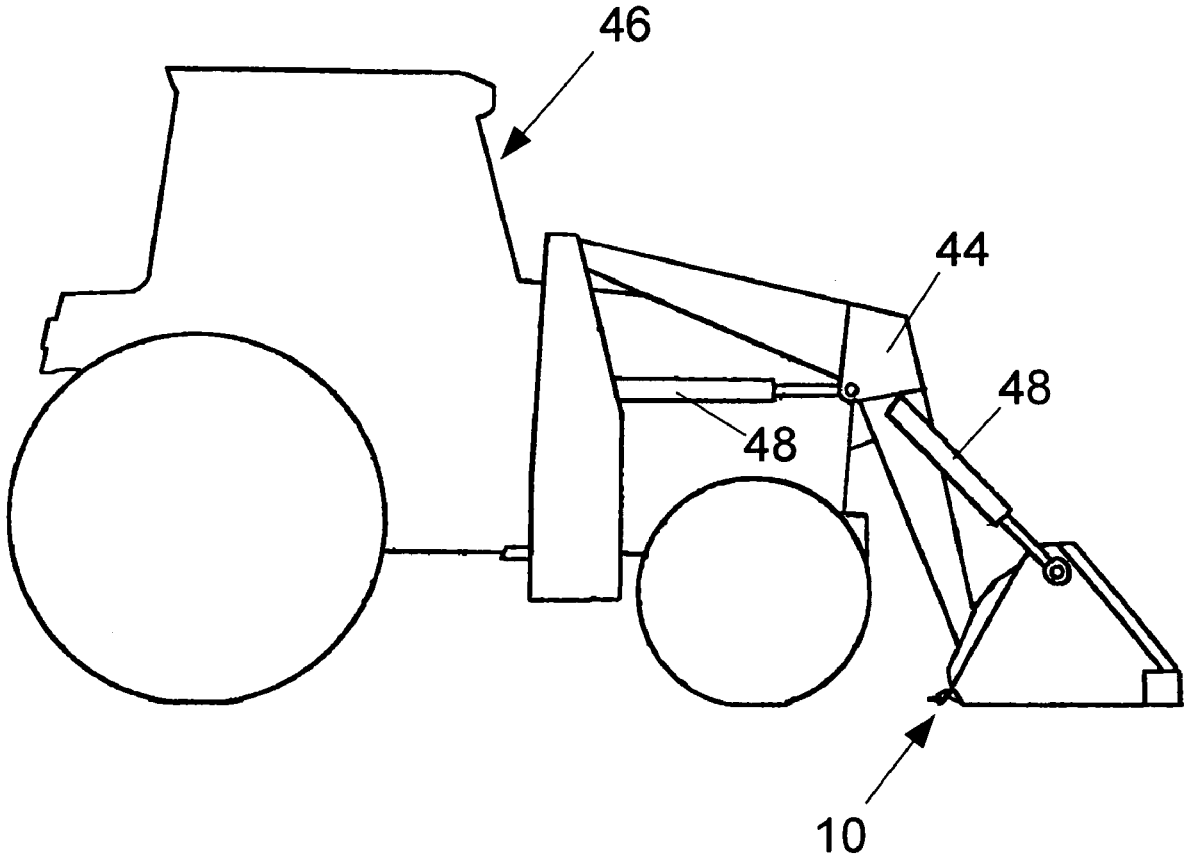
FIG. 5 is a side view of the improved material-handling bucket of the present invention connected to a vehicle.

FIG.5. shows a material-handling bucket of the present invention. The bucket includes mounts for pivotally attaching the bucket to vertically movable arms 44 about a pivot point. The arms are in turn connected to a tractor, skid steer or other vehicle 46 about another pivot point. The bucket may be raised and lowered in relation to the vehicle by the vertically movable arms. By further means well known in the art, the bucket may also be rolled forward and backward. The bucket is typically raised and lowered, and also rolled forward and backward, with hydraulic cylinders 48, although other means are well know in the art. Finally, the bucket may be moved horizontally by movement of the vehicle to which it is attached, but other means for horizontal movement of the bucket are also contemplated and within the scope of the present invention.

It is further contemplated that the rear blade of the present invention may be used in connection with other farm, construction and landscaping implements. For example, the rear blade of the present invention could be attached to the rear of a dozer blade so that, when the dozer blade is raised and rotated backward, the rear blade, with or without scarifying teeth, could be placed in contact with the ground. In this position, the rear blade could be dragged backwards to grade and level ground. The rear blade with scarifying teeth could be dragged backwards to break up and scarify the ground. Then, when the dozer blade is rotated forward and lowered, the scarified ground could be dozed. The rear blade of the present invention would thus be a useful addition to almost any implement that can be raised and lowered, and also rolled forward and backward.

Other alterations, variations, and combinations are possible that fall within the scope of the present invention. Although the preferred embodiment of the present invention has been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

What is claimed is:

1. A material-handling bucket capable of attachment to a tractor, skid steer, or vehicle so that the bucket may be raised and lowered vertically and also rotated backward for the collection of material and forward for the dumping of material, the bucket comprising:

a first side;

a second side;

a bottom side extending between the first side and the second side;

a rear side extending between the first side and the second side to form an open container for collecting material;

a blade with a blade edge for smoothing, the blade attached to and extending from the rear side of the bucket to the blade edge so that, when the bucket is rotated backward to a first orientation, the blade is moved into an operative position, so that the blade may be placed in contact with the ground and used as a scraper blade; and the blade having a blade surface and a plurality of connection areas, the blade surface extending from the blade edge towards the rear of the bucket to the plurality of connection areas, the plurality of connection areas distant from the blade edge, a plurality of teeth extending out from the blade surface at the connection areas, the plurality of teeth attached to the blade so that, when the bucket is rotated backward to a second orientation, the teeth may be inserted in the ground and used to scarify the ground.

2. The bucket of claim 1 wherein the blade is removably attached to the bucket.

3. The bucket of claim 1 wherein the teeth are welded to the blade.

4. The material-handling bucket of claim 1 further comprising:

the blade edge capable of smoothing, scraping, and grading the ground;

the plurality of teeth each having a tooth edge for engaging the ground;

the blade edge and the tooth edges substantially equidistant from the rear side of the bucket; and the blade edge substantially immobile relative to the tooth edges.

5. The material-handling bucket of claim 1 wherein the plurality of teeth are distant from and immobile relative to the blade edge, and the plurality of teeth are proximal to the blade only at the connection areas.

6. The material-handling bucket of claim 1 further comprising:

the blade being capable of contacting the ground while both the bottom side of the bucket and the plurality of teeth are separated from the ground; and the plurality of teeth substantially immobile relative to the rear side of the bucket.

7. The material-handling bucket of claim 1 further comprising the blade substantially immobile relative to the rear side of the bucket;

the plurality of teeth immobile relative to the rear side of the bucket;

the material-handling bucket having a first rotational state for digging, a second rotational state for scraping and grading, and a third rotational state for scarifying;

the material-handling bucket in the first rotational state having the lowest portion of the bottom side positioned below the lowest portions of both the blade and plurality of teeth;

the material-handling bucket in the second rotational state having the lowest portion of the blade positioned below the lowest portions of both the bottom side and the plurality of teeth; and the material-handling bucket in the third rotational state having the lowest portion of the plurality of teeth positioned below the lowest portions of both the bottom side and the blade.

8. The material-handling bucket of claim 7 wherein the second rotational state being an intermediate state between the first rotational state and the third rotational state.

9. The material-handling bucket of claim 7 wherein the third rotational state being an intermediate state between the first rotational state and the second rotational state.

10. A material-handling bucket capable of attachment to a tractor, skid steer, or vehicle so that the bucket may be raised and lowered vertically and also rotated backward for the collection of material and forward for the dumping of material, the bucket comprising:

first side;

a second side;

a bottom side extending between the first side and the second side;

a rear side extending between the first side and the second side to form an open container for collecting material;

a blade with a blade edge for smoothing, the blade attached to and extending from the rear side of the bucket to the blade edge so that, when the bucket is rotated backward to a first orientation, the blade is moved into an operative position, so that the blade may be placed in contact with the ground and used as a scraper blade; and the blade having a blade surface extending from the blade edge towards the rear of the bucket, wherein the blade is removably attached to the rear side of the bucket and a plurality of teeth wherein, each of the plurality of teeth is rigidly stationary relative to both the blade surface and the blade edge, and each of the plurality of teeth extends from the blade surface at a location distant from the blade edge.

11. A material-handling bucket capable of attachment to a tractor, skid steer, or vehicle so that the bucket may be raised and lowered vertically and also rotated backward for the collection of material and forward for the dumping of material, the bucket comprising:

first side;

a second side;

a bottom side extending between the first side and the second side;

a rear side extending between the first side and the second side to form an open container for collecting material;

a blade with a blade edge for smoothing, the blade attached to and extending from the rear side of the bucket to the blade edge so that, when the bucket is rotated backward to a first orientation, the blade is moved into an operative position, so that the blade may be placed in contact with the ground and used as a scraper blade; and the blade having a blade surface extending between the rear side and the blade edge for smoothing, scraping, and grading the ground; wherein the blade is welded to the rear side of the bucket;

the blade surface has a plurality of welds distant from the blade edge, the plurality of welds are aligned substantially parallel to the blade edge; and a plurality of teeth connect to and extend away from the blade surface at the plurality of welds, the plurality of teeth stationary relative to the blade edge.

12. A material-handling bucket capable of attachment to a tractor, skid steer, or vehicle so that the bucket may be raised and lowered vertically and also rotated backward for the collection of material and forward for the dumping of material, the bucket comprising:

a first side;

a second side;

a bottom side extending between the first side and the second side;

a rear side extending between the first side and the second side to form an open container for collecting material;

a blade attached to the rear side, the blade having a blade surface extending from the rear side to a leading blade edge; and a plurality of teeth immobile relative to both the blade edge and the blade surface, wherein each tooth of the plurality of teeth is substantially separated from the blade edge and each tooth extends from the blade surface at a location distant from the blade edge to a tooth edge distant from the blade edge.

13. A vehicle comprising:

a first power means for moving the vehicle forward and backward;

an arm having a first end and a second end, the first end of the arm pivotally connected to the vehicle at a first pivot point so that the arm is capable of rotational movement about the first pivot point, allowing the second end of the arm to be vertically raised and lowered relative to the vehicle;

a material-handling bucket having a first side, a second side, a bottom side extending between the first side and the second side and a rear side extending between the first side and the second side to form an open container for collecting material, the bucket being pivotally connected to the second end of the arm at a second pivot point so that the bucket is capable of rotational movement about the second pivot point, allowing the bucket to rotate relative to the vehicle so that when the bucket is rotated backward material may be collected in the bucket and when the bucket is rotated forward material may be dumped from the bucket;

a second power means for raising and lowering the bucket relative to the vehicle;

a third power means for rotating the bucket relative to the vehicle; and a blade including both a leading edge and a plurality of teeth substantially separated from the leading edge, the blade attached to and extending from the rear side of the bucket so that, when the bucket is rotated backward, the blade is moved into an operative position, so that the blade may be placed in contact with the ground and used as a scraper blade when the vehicle is moved backward or forward, the plurality of teeth attached to a surface of the blade, distant from the leading edge of the blade, and stationary relative to both the bucket and the blade edge.

14. The material-handling bucket of claim 13 further comprising:

the leading edge capable of smoothing, scraping, and grading;

each of the plurality of teeth extending from a connection point on the blade to a tooth edge, the tooth edge substantially parallel to the leading edge of the blade, both the tooth edge and the connection point
distant from and
immobile relative to the leading edge of the blade.

15. A material-handling loader for use with tractors, skid steers and vehicles comprising:

a bucket having a front side with an opening for the collection and transport of material and a rear side;

a blade extending from and rigidly attached to the rear side of the bucket, the blade having a blade surface located in a blade plane, the blade surface extending from the rear side of the bucket to a leading blade edge, and substantially the length of the rear side;

a plurality of teeth
connecting to the blade surface,
extending away from the blade plane ,
stationary relative to the blade, and
distant from the leading blade edge;

each of the plurality of teeth having a leading tooth edge that is distant from, immobile relative to, and substantially parallel to the leading blade edge.

16. The loader of claim 15, wherein the plurality of teeth are welded to the blade surface;

the leading blade edge is substantially in the blade plane; and all of the leading tooth edges are substantially co-linear.

17. An implement capable of attachment to a vehicle so that the implement may be raised and lowered relative to the vehicle and also rotated forward and backward relative to the vehicle, the implement including a rear blade attached to and extending from the rear of the implement in a position that does not interfere with normal operation of the implement but that is moved into position to engage the ground when the implement is raised and rotated backward, the blade having a leading edge for contacting the ground and a plurality of connection areas, the connection areas distant from the leading edge and located between the leading edge and the rear of the implement;

a plurality of non-retractable scarifying teeth carried by the blade and unmovable relative thereto, each of the plurality of teeth substantially separated from the leading edge, and each of the plurality of teeth extending from one of the connection areas of the blade
to
a tooth edge distant from the blade edge.

18. The implement of claim 17, wherein the plurality of teeth are contacting the rear blade solely at the connection areas.

* * * * *